US009835013B2

(12) United States Patent
Smith

(10) Patent No.: US 9,835,013 B2
(45) Date of Patent: Dec. 5, 2017

(54) APPARATUS AND METHOD FOR SUBSEA STRAPPING BAND ATTACHMENT

(71) Applicant: Deep Down, Inc., Channelview, TX (US)

(72) Inventor: Ron Smith, Channelview, TX (US)

(73) Assignee: Deep Down, Inc., Channelview, TX (US)

( * ) Notice: Subject to any disclaimer, the term of this patent is extended or adjusted under 35 U.S.C. 154(b) by 0 days.

(21) Appl. No.: 15/059,989

(22) Filed: Mar. 3, 2016

(65) Prior Publication Data

US 2016/0258235 A1 Sep. 8, 2016

Related U.S. Application Data

(60) Provisional application No. 62/127,550, filed on Mar. 3, 2015.

(51) Int. Cl.

| | |
|---|---|
| ***E21B 23/01*** | (2006.01) |
| ***E21B 41/04*** | (2006.01) |
| ***E21B 17/10*** | (2006.01) |
| ***B63G 8/00*** | (2006.01) |

(52) U.S. Cl.

CPC ..... *E21B 41/04* (2013.01); *B63G 8/001* (2013.01); *E21B 17/1035* (2013.01)

(58) Field of Classification Search

CPC ..... B63G 8/001; E21B 17/1035; E21B 41/04

See application file for complete search history.

(56) References Cited

U.S. PATENT DOCUMENTS 3,163,221 A * 12/1964 Shatto, Jr. ..... E21B 41/04 166/368
3,381,485 A * 5/1968 Crooks ..... B25J 11/00 405/191
3,434,682 A * 3/1969 Nestlerode, Sr. ... E21B 17/1035 248/230.8
4,602,893 A * 7/1986 Gist ..... E21B 41/04 166/338
4,620,819 A * 11/1986 Marsland ..... E21B 41/04 114/312
4,705,331 A * 11/1987 Britton ..... E02B 17/0026 24/463

FOREIGN PATENT DOCUMENTS

GB WO 2013144601 A1 * 10/2013 ..... B63C 11/52

* cited by examiner

*Primary Examiner* — James G Sayre
(74) *Attorney, Agent, or Firm* — Osha Liang LLP

(57) ABSTRACT

A system for installing a band around a rigid subsea structure includes a remotely operated vehicle (ROV) having a main body. A set of jaws extendable beyond an outer perimeter of the main body are coupled to the ROV. The system also includes a band distribution system operatively and a band installation mechanism operatively coupled to the ROV.

18 Claims, 8 Drawing Sheets

APPARATUS AND METHOD FOR SUBSEA STRAPPING BAND ATTACHMENT

BACKGROUND

Field of the Disclosure

Embodiments disclosed herein relate generally to subsea attachment of cables, umbilicals, tubes, and/or flow lines to rigid and/or fixed structures. In particular, embodiments disclosed herein relate to an apparatus and method by which rigid and semi-rigid subsea umbilicals and flow lines can be externally attached by remotely operated vehicles ("ROV") to fixed subsea structures to ensure said subsea umbilicals and flow lines are kept in a fixed location, orientation, placement, or alignment during the umbilical or flow line operational lifetime.

Background Art

Umbilicals and flow lines are used, for example, to transfer hydraulic, optical or electrical power, communication data, or provide chemical transfer pathways between subsea-to-subsea or topside-to-subsea components in the offshore oil and gas exploration and production industry. On a given offshore structure, i.e., production platform, the number of umbilicals and flow lines can increase to the point that the number of flow lines and umbilicals impact the efficiency and productivity of a given operating production platform.

As the complexity of the network of subsea control lines and hydrocarbon flow lines increase, properly routing and affixing the associated umbilicals and flow lines to a fixed or rigid structure, i.e., a chain, riser, leg of a rig, or pipe may be advantageous. Improperly clamping or otherwise fixating interconnecting flow lines and umbilicals allows said flow lines and umbilicals to move freely and can lead to increased risk of damage, leakage, or operating costs incurred when repairs to a damaged umbilical or flow line are implemented. Flow lines and umbilicals are increasingly placed in deep water, e.g., several miles-deep, locations. Human divers are restricted to only several hundred feet of depth, given current technology, and are unable to secure flow lines and umbilicals in deep water.

SUMMARY OF INVENTION

In one aspect, embodiments disclosed herein relate to a system for installing a band around a rigid subsea structure includes a remotely operated vehicle (ROV) having a main body, a set of jaws extendable beyond an outer perimeter of the main body on the ROV. The system also includes a band distribution system operatively and a band installation mechanism operatively coupled to the ROV.

In another aspect, embodiments disclosed herein relate to a method of installing a band around a subsea structure and at least one flow line including securing a remotely operated vehicle (ROV) to a subsea structure with a set of jaws coupled to the ROV. A buckle may be placed in a loading area between the ROV and the subsea structure. A band may then be fed through a first latch of the buckle and around the subsea structure with a band installation mechanism. The band may engage with a second latch of the buckle. Once engaged, the band may be tightened around the subsea structure and flow line and the band may be cut.

In another aspect, embodiments disclosed herein may relate to a method including installing a first band around a rigid subsea structure and flow line with an ROV, wherein the installing is controlled by an operator at the surface.

Other aspects and advantages of the disclosure will be apparent from the following description and the appended claims.

DETAILED DESCRIPTION

In one aspect, embodiments disclosed herein relate to an apparatus and method for securing flow lines and umbilicals to rigid and/or fixed structures (e.g., risers, pipes, rig leg, platform, chains) in deep water. More specifically, the present disclosure relates to a remotely operated vehicle (ROV) having a subsea banding system to secure a flow line or umbilical to a rigid structure. The subsea banding system may include at least a set of jaws, a band distribution system, and a band installation mechanism. As used herein, the term "band installation" or "band installation operations" is used to refer to the process of securing a flow line or umbilical to a rigid structure. Band installation operations include aligning the ROV and set of jaws with the rigid structure, closing the set of jaws around the rigid structure, providing a band and buckle to a loading area between the rigid structure and band distribution system, guiding the band around the rigid structure, tightening the band, and cutting the secured band.

Banding installation operations in accordance with embodiments disclosed herein provide a method to secure flow lines in deep water to a rigid structure. As used herein, the term "deep water" will refer generally to a depth of about several hundred feet to several miles. Additionally, the term "flow line" will refer to any loose (i.e., free or not attached to a fixed or rigid structure) control line, cable, rope, umbilical, and/or flow line. The use of the terms deep water and flow line is not intended to limit the scope of the application.

Figure 1:
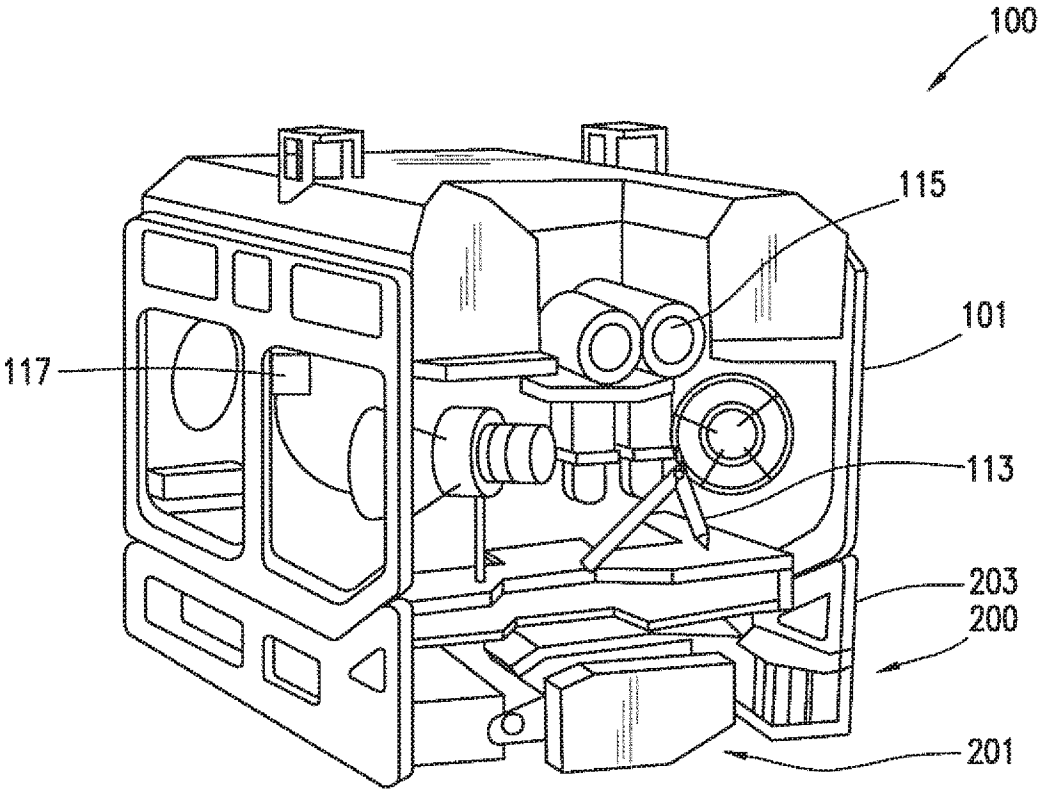
FIG. 1 shows perspective view of a portion of an ROV in accordance with embodiments of the present disclosure.

Referring to FIG. 1, a ROV 100 in accordance with embodiments of the present disclosure is illustrated. The ROV 100 includes at least a main body 101 and a skid 200. A banding system 201 may be positioned on the skid 200 coupled to the ROV 100. However, one skilled in the art will understand that the banding system 201 may be located on the main body 101 of the ROV 100 without departing from the scope of the present disclosure.

The main body 101 includes at least one manipulator arm 113 coupled thereto, a control center 117, a plurality of sensors (not separately shown), and an onboard camera system 115. The control center may be operatively coupled to, for example, at least one manipulator arm 113, the onboard camera system 115, and/or the plurality of sensors. The control center 117 may send instructions to and/or receive feedback from any component coupled to the control center, e.g., the at least one manipulator arm 113, the onboard camera system 115, the plurality of sensors, and the banding system 201. The control center 117 may be, for example, a microprocessor. The control center 117 may communicate (send and receive signals, data, etc.) with the surface in real time with, for example, wireline, wireless, optical, and acoustic communication devices known in the art. This communication allows users at the surface to monitor the ROV while the ROV is deployed underwater. The main body 101 may also include a plurality of power taps (e.g., electrical, hydraulic, pneumatic) for providing a power source to onboard tools (e.g., control center 117, onboard camera system 115, manipulator arms 113, banding system 201, etc.)

The onboard camera system 115, or at least one camera of the onboard camera system 115, may be positioned to provide a view of the components of the banding system 201. This allows the user to visually monitor the progress of the band installation process and verify proper installation of the banding unit. One skilled in the art will understand that the relative position of the onboard camera system 115, the control center 117, and the banding system 201 is not intended to limit the scope of the present disclosure.

The plurality of sensors may be located throughout the main body 101 of the ROV 100. The sensors may be provided to monitor, for example, speed, depth, pressure, and temperature of the ROV 100 and the surroundings while underwater. Examples of sensors that may be used include temperature sensors, pressure sensors, accelerometers, position sensors, depth, torque, etc. Sensors may also be provided to the main body 101 of the ROV to detect the proximity of underwater structures. Sensors may also be provided to various components located on the ROV, for example, at least the manipulator arm 113 and banding system 201. The measurements taken by the sensors may be transmitted to and from the control center and monitored from the surface. Monitoring the ROV with sensors allows a user to communicate with the ROV 100 in the event that a reading from the sensors indicates that a value of the sensed or monitored parameter is beyond an acceptable range (for example, if the depth is greater than desired, if the pressure exceeds a known limit, etc.).

The banding system 201 may be located on a skid 200 coupled to the main body 101 of the ROV 100. The skid includes at least a frame 203 coupled to a bottom face of the ROV 100. The frame 203 may be coupled to a bottom face of the ROV 100 with a mount 205. The mount 205 may be any mounting means known in the art. For example, the mount 205 may include a plurality of pins or bolts 207 arranged to mate with corresponding recesses on a bottom face of the ROV 100. One skilled in the art will understand that the type of mount 205 and/or pin 207 configuration is not intended to limit the scope of the present disclosure. The skid 200 may also include bumpers 209 disposed on one or more outer surfaces to protect, for example, a front face of the skid 200 in the event the ROV 100 collides with an object during operation. The bumpers 209 may be mounted to the frame 203 the skid with, for example, screws, bolts, rivets or mechanical fasteners, adhesives, and other mounting means known in the arts. The bumpers may be formed from elastomeric materials, e.g., ultra-high-molecular-weight polyethylene, nylon, DELRIN (an acetal resin), etc.

Figure 2:
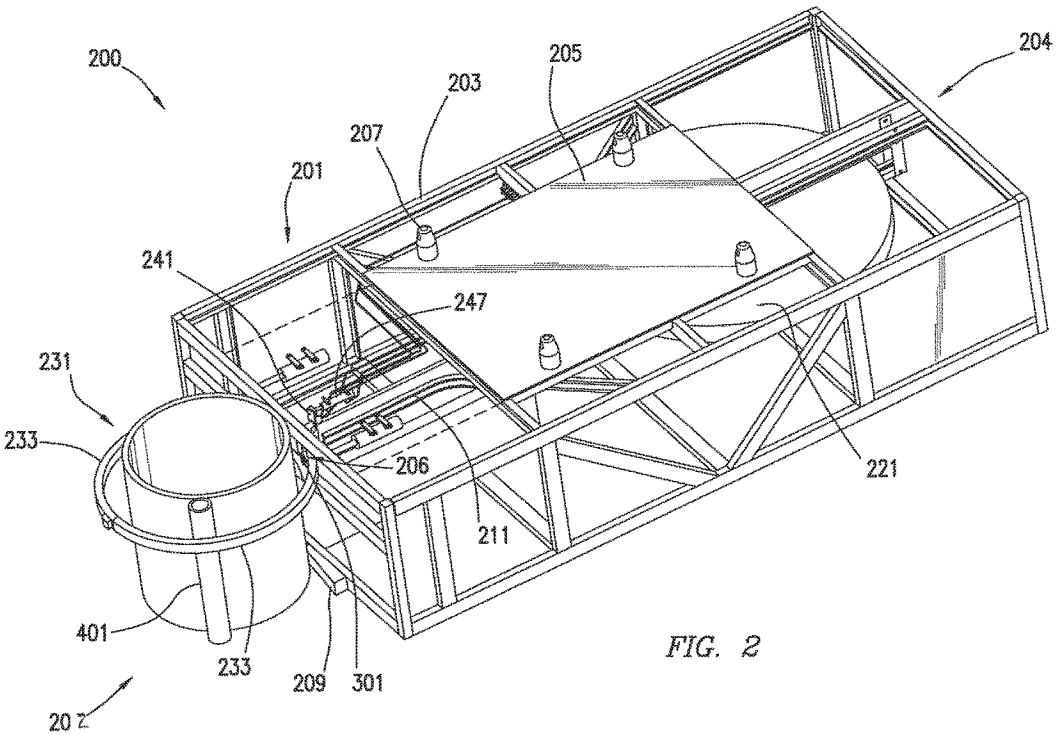
FIG. 2 shows a perspective view of a skid in accordance with embodiments of the present disclosure.

In some embodiments, the skid 200 may house the banding system 201. The banding system 201 aligns the ROV 100 with the rigid structure 301 (for example, a pipe is shown in FIG. 2) and installs a band unit (300 in FIG. 3) around the rigid structure 301 to secure flow lines (401) to the rigid structure 301. In embodiments in accordance with this disclosure, an existing ROV may be retrofitted with the banding system 201. For example, skid 200 as described herein may be mounted to a bottom face of the ROV 100. One skilled in the art will understand that the type of ROV 100 used with the banding system 201 is not intended to limit the scope of the present disclosure. The banding system 201 shown includes at least a jaw 231, a band distribution system 211, and a band installation mechanism 241.

The jaw 231 includes a set of arms 233 pivotally mounted to the skid 200. In some embodiments, the set of arms 233 may be pivotally mounted to an extension member. As used herein, the term "extension member" may refer to the band installation mechanism 241 or a separate component dedicated to extending/retracting the jaw 231. In some embodiments, the set of arms 233 may be coupled to a front end of the band installation mechanism 241. The arms 233 may have a substantially arcuate geometry. One skilled in the art will understand that the shape of the arms 233 are not limited to a single geometry, for example, the arms 233 may have an elliptical, semi-circular, angled shape, and that each arm 233 may not have the same shape. In some embodiments, the geometry of the arms 233 may correspond to the geometry of rigid structure 301 to which the banding system 201 attaches the flow line 401.

Figure 6:
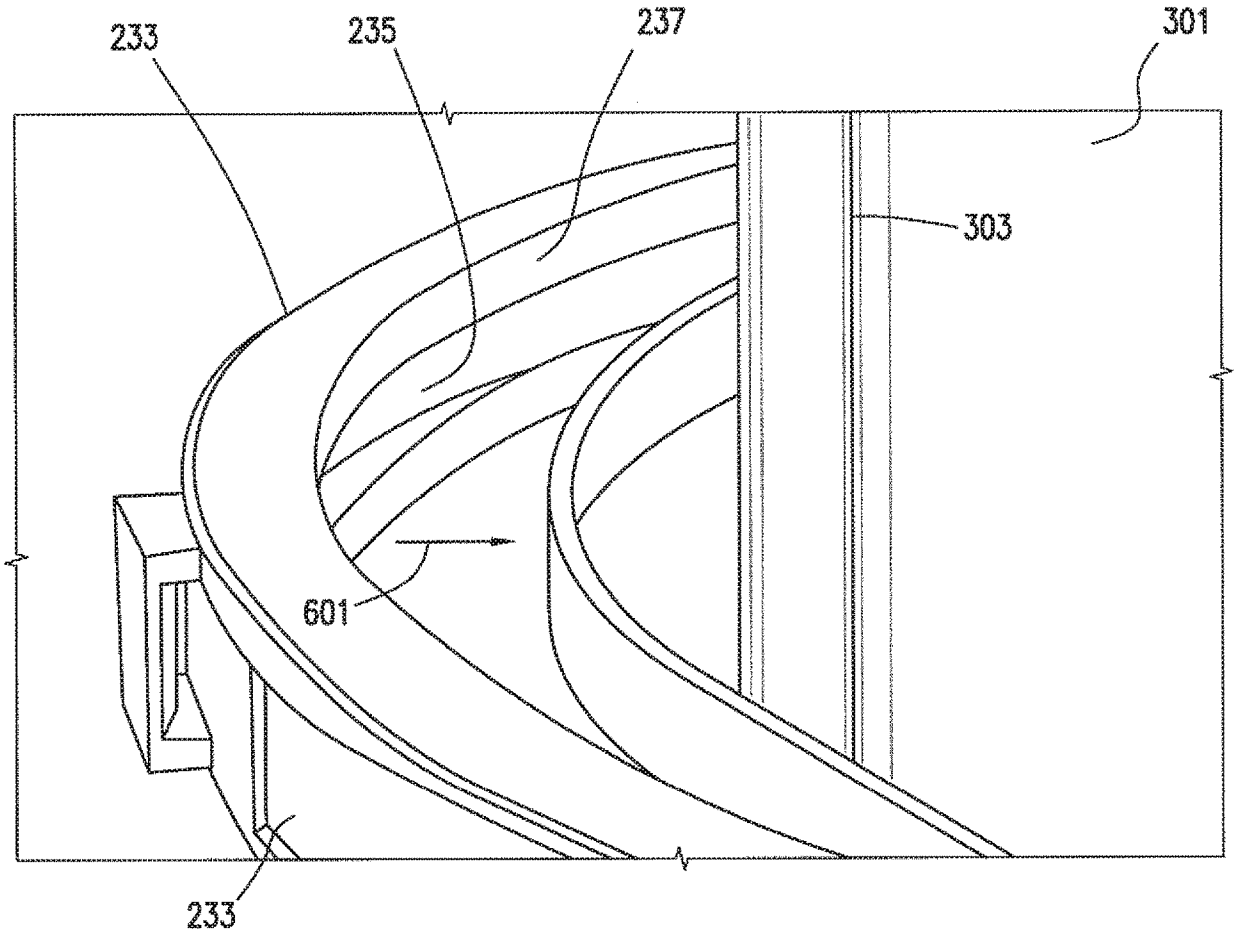
FIG. 6 shows a detailed view of the arms of the band installation system.

The arms 233 are actuated between an open position (not shown) and a closed position (shown in FIG. 2). Referring additionally to FIG. 6, the arms 233 of the jaw 231 may include a channel 235 located on an inner surface thereof running along a length of each arm 233. The channel 235 may facilitate movement of a band (303 in FIG. 3) around the subsea structure. A plurality of retention members 237 may be positioned across the channel 235. In some embodiments, the retention members 237 may be, for example, a plurality of spring loaded pins spaced around an inner surface of arms 233, each member positioned in a corresponding groove or cavity formed in the inner surface of arms 233. In other embodiments, for example, as shown in FIG. 6, the retention members 237 may be a flexible rubber strip or wiper located at a top and bottom of the inner surface of arms 233. Arrow 601 indicates the direction of movement of band 303 radially inward toward the subsea structure 301. The retention members 237 may help keep the band (303 in FIG. 3) in the channel 235 during movement and allow the band (303 in FIG. 3) to exit the channel 235 and tighten around the subsea structure 301 and flow line 401.

The set of arms 233 may be extendable and retractable with respect to the skid 200 and an outer perimeter of the ROV 100 and/or skid 200. For example, while the ROV 100 is moving underwater the jaw 231 may be in a retracted position such that the jaw 231 is located within an outer perimeter of the ROV 100. Once the ROV 100 approaches the rigid structure 301 to begin banding installation operations, the jaw 231 may be extended by, for example, a piston cylinder, gear drive, mechanical linkage, electric motor, and/or hydraulic motor. The extension member (not shown) and/or band installation mechanism 241 may retract and/or extend by pivoting about a point, e.g., the extension member may pivot about an end connected to the ROV 100, or by translating, i.e., sliding longitudinally, within the ROV 100, e.g., the extension member may be positioned in a track for relative movement with respect to the ROV 100. As used herein, the terms "longitudinal" refers to the long axis running from a front end 202 to a rear end 204 of the skid 200 and/or ROV 100.

One skilled in the art will understand a variety of actuating means may be used to close the arms 233 around the fixed structure 301 and flow line 401. A user at the surface may send instructions to a control center to actuate the jaw 231 to close the arms 233. In some embodiments, the user may communicate directly with the jaw 231. The arms 233 may be actuated, i.e., opened and closed, by for example, springs, a hydraulic piston, a pneumatic piston, a solenoid, or any suitable actuating means known in the art. The arms 233, may be electrically, mechanically hydraulically, and/or pneumatically actuated. A signal may be sent from the control center to the actuating means to actuate (move the arms 233 to a closed position) or deactuate (move the arms 233 to an opened position) the actuating means.

In some embodiments, a sensor may be positioned on the arms 233 to detect the rigid structure 301, and/or determine if the ROV 100 is positioned for banding operations. For example, a touch sensor may be located on an inner surface of the arms 233. Once the extension member moves the attachment member 125 into contact with the rigid structure 301, the touch sensor signals the control center and the control center actuates the arms 233 to move the arms 233 into the closed position, i.e., to close the arms 233 around the rigid structure 301 to secure the ROV 100 in place relative to the rigid structure 301. In another embodiment, the arms 233 may be spring actuated, for example, contacting the attachment member 125 against the rigid structure 301 may cause actuating members 127 to close the arms 233.

Figure 3:
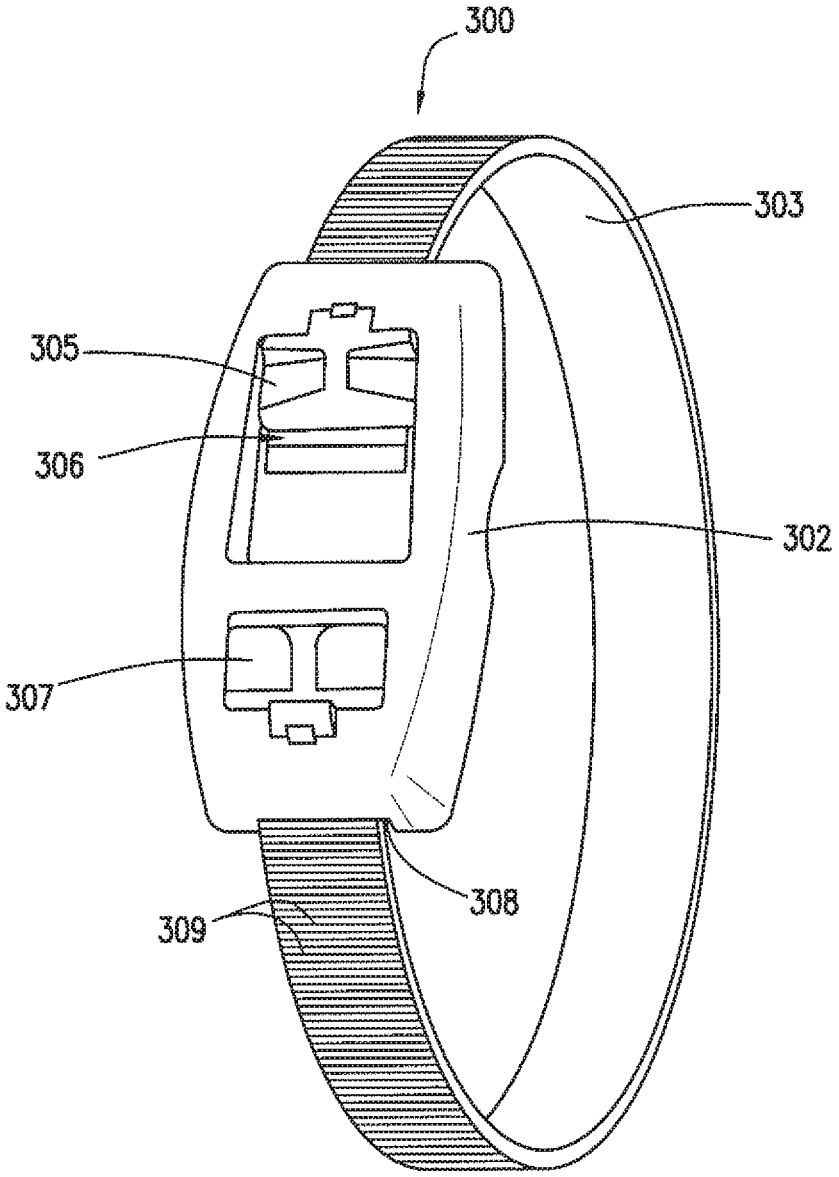
FIG. 3 shows a conventional band unit in accordance with embodiments of the present disclosure.

Referring to FIGS. 2 and 3, the band distribution system 220 supplies components of a band unit (300 in FIG. 3) to a loading area 206 located between the banding system 201, e.g., jaw 231, and the rigid structure 301. A band unit 300 includes a buckle 302 and a band 303. The band 303 may include a plurality of teeth 304 located on at least one side of the band 303. The buckle 302 may include a first latch 305 and a second latch 307. The first latch 305 and the second latch 307 include a first band slot 306 and second band slot 308, respectively. The band unit 300 may be, for example, a Smart® Band Hybrid from HCL Clamping Solutions (Houston, Tex.) adapted for use on an ROV. For example, the buckle 302 may be modified to interact with a guide member 215 (FIG. 4) and be held in the loading area 206; the first and second latch 305 and 307 may be modified to enable opening and closing the latches more easily; and the first and second latches 305 and 307 may be modified to allow the band 303 to more easily enter the first and second band slots 306 and 308, respectively.

The band distribution system 220 includes at least a buckle magazine 211 and a drum 221, as shown in FIG. 2, having a length of band 303 loaded thereon. The band distribution system 200 allows a buckle unit 300 in FIG. 3 to be assembled and installed by an ROV 100 at a banding site underwater. One skilled in the art will understand that in other embodiments, the band distribution system 220 may provide a pre-assembled band unit 300 such that each band unit 300 has at least one end of a band 303 engaged with the first latch 305 of the buckle 302 prior to being loaded into the banding system 201.

The buckle magazine 211 may be located proximate a front end 202 of the skid 200. The buckle magazine 211 houses a plurality of buckles 302. The plurality of buckles may be loaded within the buckle magazine 211 so as to be individually dispensed to the loading area 206. According to the embodiment shown in FIG. 4, the buckle magazine 211 includes a plurality of buckles 302 arranged in a spring loaded column such that a bottom face of a first buckle is adjacent a top face of a second buckle. A spring 213, e.g., a coil spring, is provided to a back end of the buckle magazine 211 to urge the column of buckles toward a front of the buckle magazine 211. The buckle magazine 211 includes an opening 212 on a top and bottom face of the buckle magazine. The opening 212 allows guide member 215 to urge the buckle 302 out from the buckle magazine 211 and into the loading area 206.

The buckle magazine 211 may include one or multiple columns of buckles and may be located above or below loading area 206. The buckle magazine 211 may move along a width of the skid 200 so as to position the buckle 302 to be dispensed over the loading area.

Figure 5:
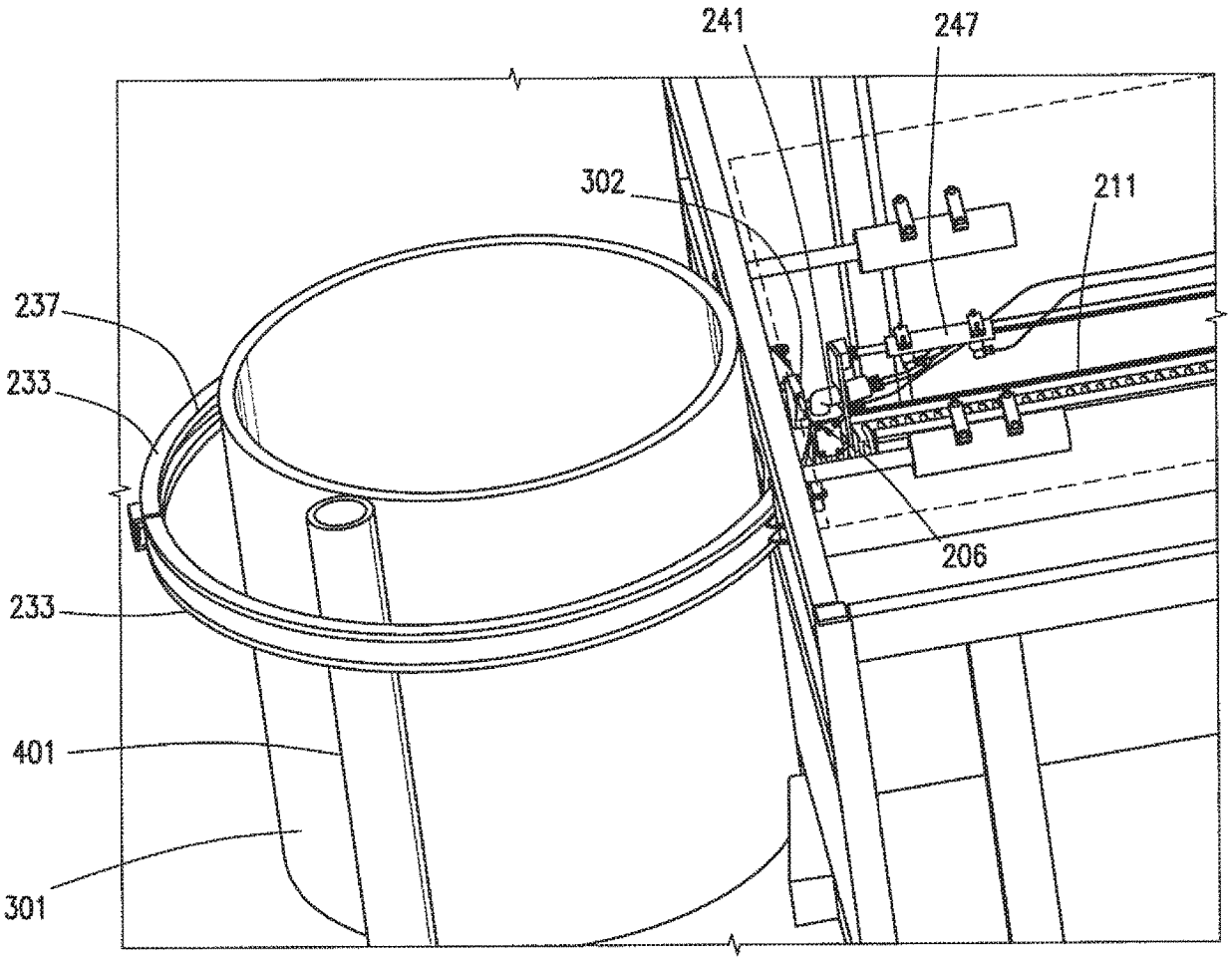
FIG. 5 shows a perspective detailed view of a skid in accordance with one of the embodiments of the present disclosure.
Figure 7:
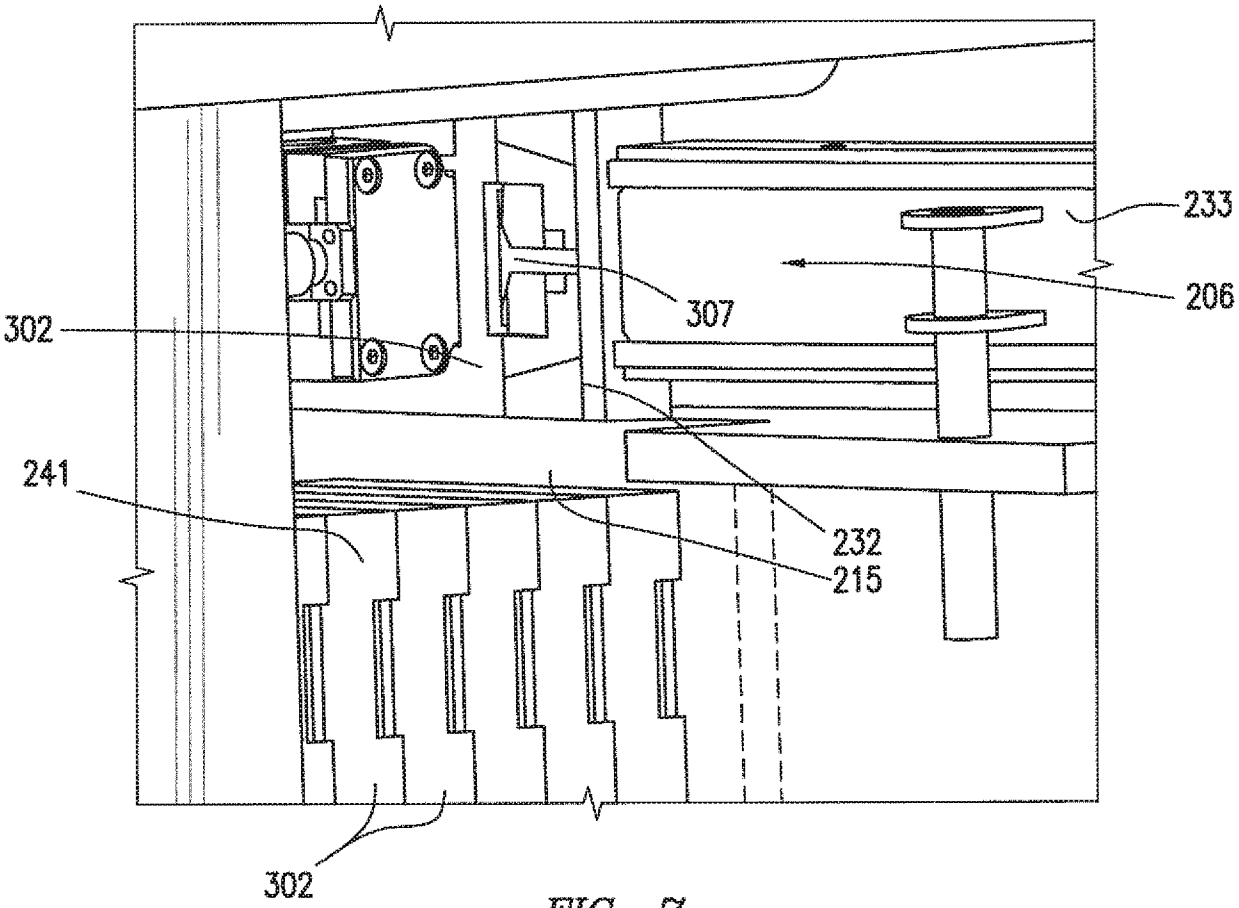
FIG. 7 shows a perspective detailed view of the loading area of the band installation system in accordance with one of the embodiments of the present disclosure.
Figure 8:
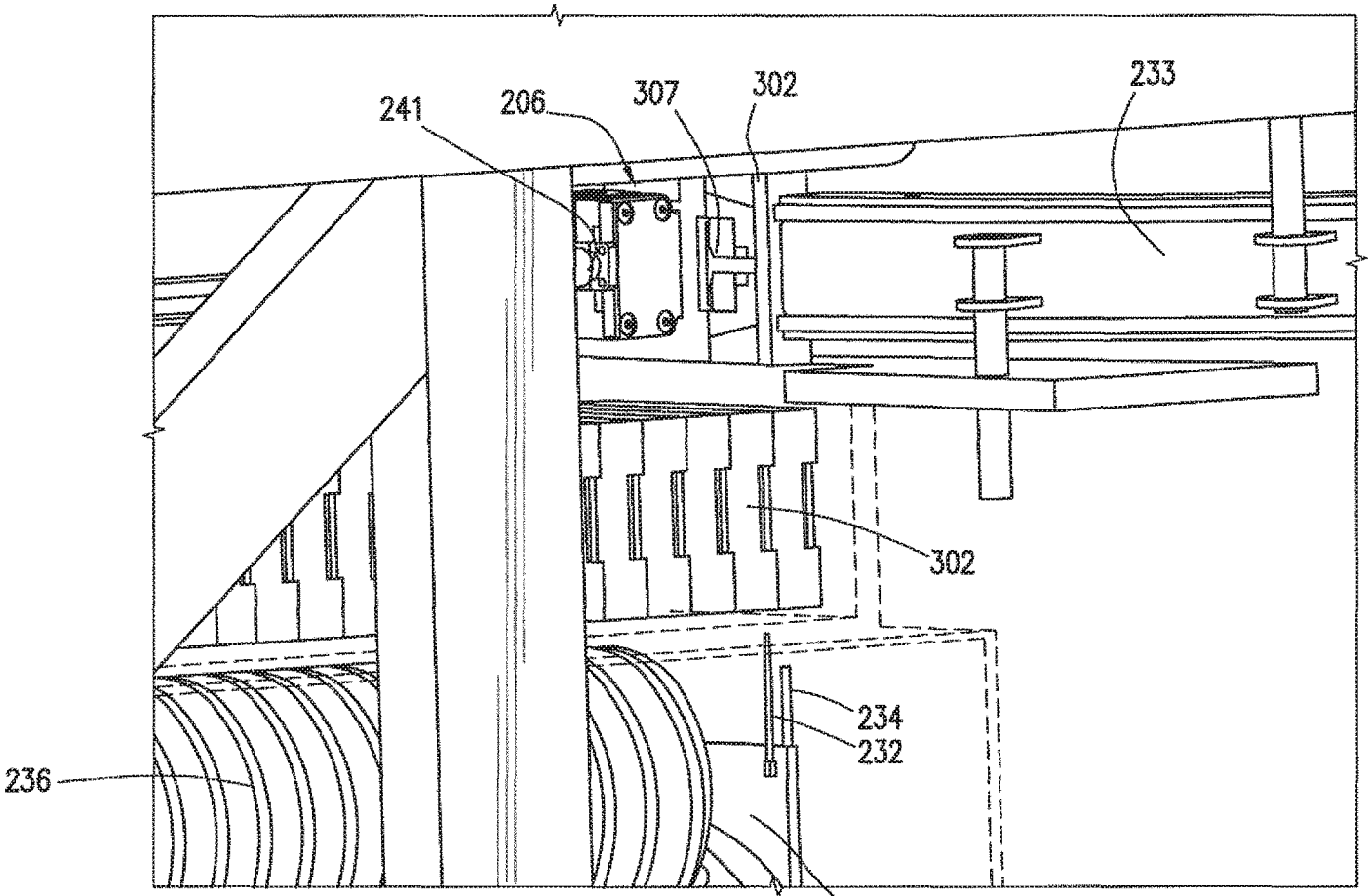
FIG. 8 shows a perspective detailed view of the loading area of the band installation system in accordance with one of the embodiments of the present disclosure.

According to the embodiment shown in FIGS. 5, 7, and 8, a single column of buckles 302 may be included in the buckle magazine located over the loading area 206 and/or movable along the width of the skid 200. The buckle magazine 211 may be located below the loading area 206 such that the guide member 215 urges the buckle 302 in an upward direction. Guide member 215 may include at least two stabilizing pin members 234 located on a first end and second end of the guide member 215 and protruding in an upward direction. The stabilizing pin members are provided to engage the buckle 302 and hold the buckle 302 in the loading area 206 during banding operations. At least one latching pin member 232 may be positioned on a second end of the guide member 215 so as to hold the second latch 207 in an open position during banding operations.

Referring to FIG. 8, the buckles 302 are driven by a coil 236. The coil 236 may run a length of the buckle magazine 211, such that a top portion of each coil is positioned between two adjacent buckles. When the coil is rotated by a motor, the buckles 302 will advance in a forward fashion similar to a vending machine. One skilled in the art will understand that the mechanism used to dispense the buckles is not intended to limit the scope of the present disclosure. For example, the buckles 302 may be provided to the loading area 206 by a coil spring 213, a coil drive 236, or have a rotary indexer (not shown) to dispense the buckle 302.

The drum 221 of the band distribution system 220 supplies band 303 to the buckle 302 once the buckle 302 is located in the loading area 206. Referring to FIG. 2, the drum 221 contains a length of band 303 wound thereon. The drum may hold about 400-1000 ft of band 303. The length of the band 303 may be selected so that there is a sufficient amount of band units to correspond to the number of buckles in the magazine. In some embodiments, the width of the band 303 may vary along the length of the band 303. One skilled in the art will understand that different sized drums may hold a different length of band 303. The length of band 303 contained on the drum 221 is not intended to limit the scope of the present disclosure. A loose end of the band 303 may be engaged with the band installation mechanism 241. At least one spindle (not individually shown) may be included between the drum 221 and the band installation mechanism 241. The band 303 located between the drum 221 and the band installation mechanism 241 may wrap around the spindle so as to moderate the tension on the band 302.

Figure 4:
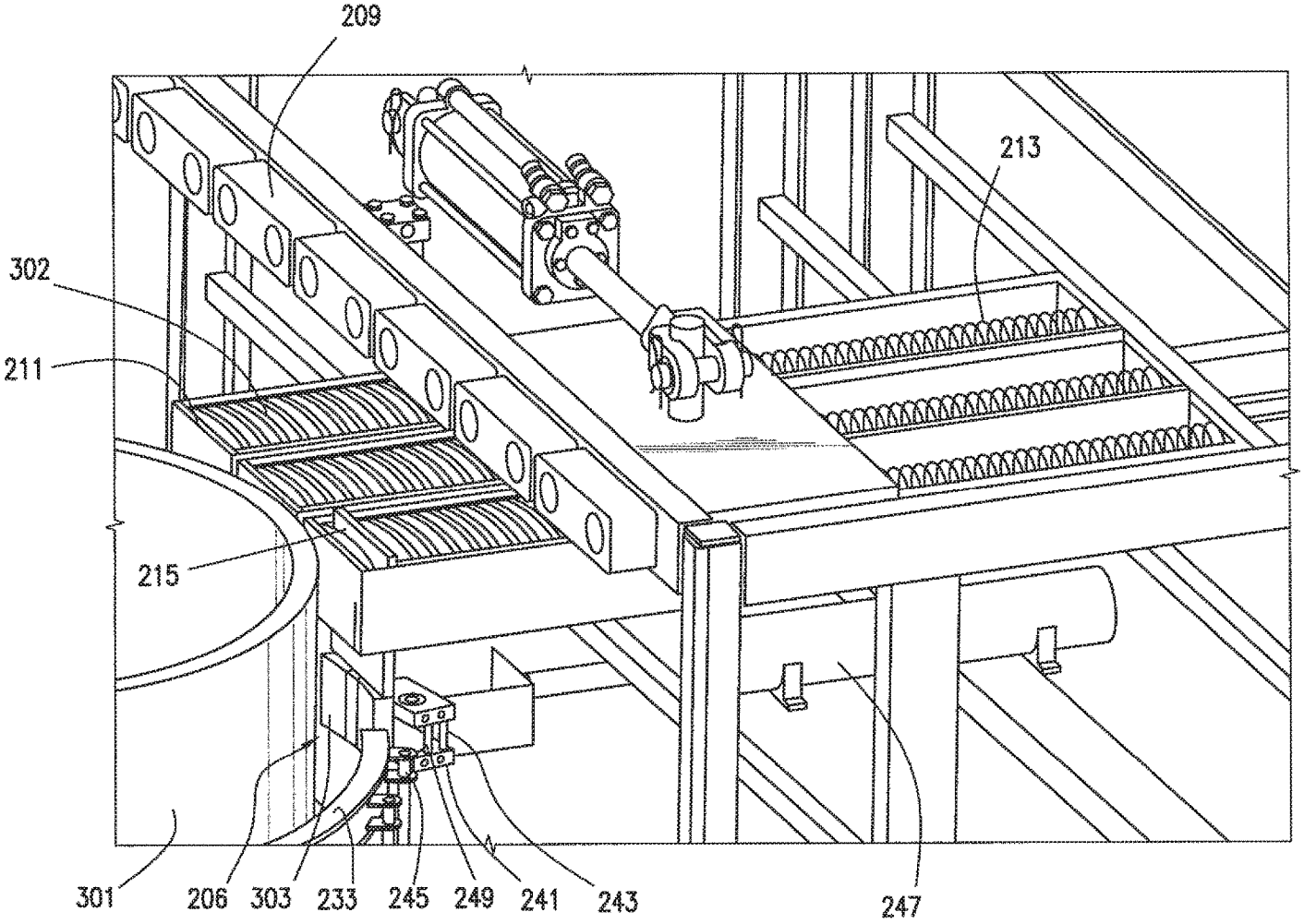
FIG. 4 shows a perspective detailed view of a skid in accordance with one of the embodiments of the present disclosure.

With reference to FIGS. 4 and 5, the band installation mechanism 241 may be positioned longitudinally between the drum 221 and the arms 233. The band installation mechanism 241 is provided to feed a loose end of the band 303 to a buckle 302 located in the loading area 206, feed the band 303 around the rigid structure 301 and flow line 401, tighten the band 303, and cut the band 303. A loose end of the band 303 may be manually positioned to engage with the band installation mechanism 241 at the surface prior to deploying the ROV 100 in water. The band installation mechanism 241 is configured to move longitudinally within the skid, for example, a cylinder 247 may position the band installation mechanism 241 in a retracted position or an extended position, shown in FIG. 5, as well as actuate a cutting blade and/or the gear for feeding the band 303. In embodiments where the jaw 231 is connected to the band installation mechanism 241, longitudinal movement of the band installation mechanism 241 causes the jaw 231 to extend and retract.

The band installation mechanism 241 may be a drive box adapted from a Smart® Installation Tool from HCL Clamping Solutions (Houston, Tex.) for use on an ROV. Referring to FIGS. 2-4, the band installation mechanism 241 includes at least a band entry slot 243, a band exit slot 245, and a cutting blade 249. The band entry slot 243 and band exit slot 245 are configured to receive a loose end of the band 303. The cutting blade is configured to cut band 303 once the band unit 300 is installed on the rigid structure 301. The cutting blade may cut the band 303 in any number of shapes, e.g., square cut, rounded cut, angled cut, etc.

The band installation mechanism 241 may pull the band 303 from the drum 221 for use in banding installation operations. The band installation mechanism 241 may drive the band 303 forward, i.e., push the band 303, through the band entry slot 243 and band exit slot 245 away from the drum 221, as well as drive the band 303 backward, i.e., pull the band toward the drum 221. The band installation mechanism 241 may be hydraulically, electrically, and/or pneumatically actuated. Once actuated, the band installation mechanism 241 drives the band 303 by using teeth 304 to ratchet and move the band 303 through the band entry slot 243 and band exit slot 245.

Referring to FIGS. 1 and 2, during subsea banding installation operations, the ROV 100 may detect and approach a rigid subsea structure 301. A user may control the path of the ROV from the surface by monitoring the movement of the ROV with the onboard camera system 115. When the ROV 100 is near the subsea structure 301 (i.e., in range of the jaw 231 and arms 233) the jaw 231 may be extended and the arms 233 opened around the subsea structure 301. In embodiments where the jaw 231 is coupled to the band installation mechanism 241, the band installation mechanism may move longitudinally toward a front end 202 of the skid 200 to extend the jaw 231. Once the arms 233 are positioned around the rigid subsea structure 301 and flow line 401, the jaw 231 may close the arms 233 around the subsea structure, thereby securing the ROV 100 to the subsea structure 301. For example, a sensor may detect that the arms 233 are positioned around the rigid structure 301 and automatically close the arms 233 around the rigid structure 301 and flow line 401. In other embodiments, a user may monitor the position of the ROV 100 with the onboard camera system 115 and determine when to close the arms 233 around the rigid structure 301.

Once the ROV 100 is secured to the rigid structure 301, the buckle magazine 211 may dispense a buckle 302 to the loading area 206. The buckles may be indexed by, for example, a coil spring (213 in FIG. 4), a coil drive (236 in FIG. 8), or a rotary indexer (not shown). Referring to FIGS. 7 and 8, with a buckle 302 indexed for loading, guide member 215 may axially urge buckle 302 into the loading area 206. The guide member 215 may hold the buckle 302 in the loading area 206 and pin 232 of the guide member 215 may hold the second latch 207 of the buckle 302 in an open position.

The band installation mechanism 241 may then feed the band 303 into the first band slot 306 of the first latch 305 of the buckle 302 and around the subsea structure 301 and flow line 401. In particular, the band installation mechanism 241 may drive the band 303 in a forward direction thereby pushing the band 303 through the first latch 205. A loose end of the band 303 will be guided into a channel 235 located along an inner surface of the arms 233 of the jaw 231. As the band installation mechanism 241 continues to drive the band 303 in a forward direction, the loose end of the band 303 will travel along the channel 303 and around the subsea structure 301 and flow line 401 until the loose end of the band 303 enters and engages the second slot 308 of the second latch 307 so that the length of band 303 positioned around the subsea structure 301 and flow line 401 has passed through the first band slot 306. In embodiments having a retention members 237 along the arms 233, the retention members may prevent the band 303 from slipping out of the channel 235 during travel.

Once the band 303 engages the second latch 307, i.e., the band 303 enters the second slot 308 and at least one tooth 304 of the band 303 engages the latch, the guide member 215 may move axially away from the loading area 206 so as to close the second latch 207. A position sensor may be used to determine when an end of the band 303 is engaged in the correct position with the second latch 307. In some embodiments, a user monitoring the video feed from the onboard camera system may visually determine if the end of the band 303 is engaged in the correct position with the second latch 307. In some embodiments, when the guide member 215 returns to an initial position (shown in FIG. 8) a signal may be sent to a motor (not shown) coupled to the coil 236 to rotate the coil 236 for indexing the buckles.

Once the second latch 207 is closed, the drive direction of the band installation mechanism 241 may then be reversed. Driving the band installation mechanism 241 in a reverse direction pulls the band 303 toward the drum 221 and allows the band 303 to tighten around the subsea structure 301 and flow line 401. As the band 303 tightens, the band 303 may push the retention members 237 outward, for example, the retention members 237 may pivot about the connection point to the arms 233, thereby allowing the band 303 to exit the channel 235 and the buckle 302 to exit the loading area 206 and have the banding unit 300 positioned flush against the rigid structure 301. In other embodiments, the band 303 may elastically deform the retention members to exit the channel 235.

Once the band unit 300 is tightened around the subsea structure 301 and flow line 401, the control center and/or user may send instructions to the band installation mechanism 241 to cut the band 303. The cutting blade 249 of the band installation mechanism 241 may then be actuated to cut the band 303. Once cut, a new loose end of the band 303 from drum 221 will be engaged with the band installation mechanism 241. In some embodiments, a sensor may be used to monitor the tension prior to the actuation of the cutting blade 249 of the band installation once a desired tension is reached.

According to some embodiments, a visual of the band installation operations is transmitted to the surface with the onboard camera system 115. The visual may provide a user or operator at the surface with a means to control and monitor the installation process and verify proper installation of the banding unit. Further, with the onboard camera system 115, a user or operator may determine the timing of the band installation operations or when to proceed to the next step, i.e., instruct the control center to provide instructions to the banding system 201. One skilled in the art may also understand that the control center may be configured to automatically determine when to execute a particular step in the installation operations. According to such an embodiment, a user or operator may be able to override automated control center instructions if desired, e.g., if an error is detected via the sensors and/or onboard camera system.

An ROV 100 having a banding system 201 may install multiple band units on a particular subsea structure and/or install at least one band unit 300 on multiple subsea structures. The ROV 100 may install a band at any depth from the surface to about 5000 ft. In other embodiments the ROV may install a band at any depth from the surface to about 3 to 5 miles. In embodiments where multiple band units are installed on a particular subsea structure, the ROV 100 may install a first band at a first depth, descend along the subsea structure and install a second band unit at a second depth.

Accordingly, embodiments disclosed herein relate to an apparatus and method of installing a subsea band unit around existing rigid subsea structures. This enables flow lines to be attached or positioned on existing subsea structures. This may prevent flow lines from tangling or being damaged due to unrestrained movement. Furthermore, band installation operations in accordance with embodiments disclosed herein will reduce waste of bands. For example, when a first band unit is installed and cut from the length band located on the drum, the newly cut end of the band will be secured in a second latch of a second subsequently installed band unit.

Although the preceding description has been described herein with reference to particular means, materials and embodiments, it is not intended to be limited to the particulars disclosed herein. Rather, it extends to all functionally equivalent structures, methods and uses, such as are within the scope of the appended claims.

What is claimed is:

1. A system for installing a band around a rigid structure comprising:

a remotely operated vehicle (ROV) having a main body;

a set of jaws extendable beyond an outer perimeter of the main body of the ROV;

a band distribution system including a buckle magazine housing a plurality of band buckles and a drum having a length of band disposed thereon; and a band installation mechanism including a cutting blade.

2. The system of claim 1, further comprising a skid attached to a bottom face of the ROV, wherein the set of jaws, band distribution system, and band installation mechanism are mounted on the skid.

3. The system of claim 1, wherein the set of jaws comprises at least two arms pivotally connected to the band installation mechanism, the at least two arms configured to open and close.

4. The system of claim 3, wherein the band installation mechanism is configured to move longitudinally to extend and retract the set of jaws.

5. The system of claim 3, further comprising a channel disposed on an inner face of the at least two arms.

6. The system of claim 1, wherein the band installation mechanism engages a portion of the length of band.

7. The system of claim 1, wherein the buckle magazine is one selected from spring loaded, rotary indexed, and coil driven.

8. The system of claim 1, wherein the buckle magazine is located below the set of jaws and band installation mechanism.

9. A method of installing a band around a subsea structure and at least one flow line comprising:

securing a remotely operated vehicle (ROV) to a subsea structure with a set of jaws coupled to the ROV;

placing a buckle in a loading area between the ROV and the subsea structure;

feeding a band through a first latch of the buckle and around the subsea structure with a band installation mechanism;

engaging the band with a second latch of the buckle;

tightening the band around the subsea structure and flow line; and cutting the band.

10. The method of claim 9, further comprising sending instructions from a user to a control center disposed on the ROV.

11. The method of claim 9, wherein at least two selected from securing, placing the buckle, feeding a band, engaging the band, tightening the band, and cutting the band are automated.

12. The method of claim 9, wherein the band is manually engaged with the band installation mechanism prior to deploying the ROV.

13. The method of claim 9, wherein the securing further comprises:

approaching the subsea structure with the ROV;

extending the set of jaws from the ROV proximate the subsea structure; and closing a set of arms of the set of jaws around the subsea structure to secure the ROV to the subsea structure.

14. The method of claim 9, wherein feeding a strap through a first latch of the buckle comprises:

driving the band installation mechanism in a forward direction, thereby pushing the band through the first latch;

guiding a loose end of the band into a channel located in the set of jaws; and directing the loose end through the channel and into the second latch.

15. The method of claim 9, wherein tightening comprises driving the installation mechanism in a backward direction.

16. The method of claim 9, further comprising sliding the strap out from the channel during tightening.

17. The method of claim 9, wherein the installing is controlled by an operator at the surface.

18. The method of claim 17, further comprising installing a second band below the band in a single trip.

* * * * *